US005340676A

United States Patent [19]

Anderson et al.

[11] Patent Number: 5,340,676

[45] Date of Patent: Aug. 23, 1994

[54] IMAGING ELEMENT COMPRISING AN ELECTRICALLY-CONDUCTIVE LAYER CONTAINING WATER-INSOLUBLE POLYMER PARTICLES

[75] Inventors: Charles C. Anderson, Penfield; Mario D. DeLaura, Hamlin; Paul A. Christian, Pittsford; Ibrahim M. Shalhoub, Pittsford; David F. Jennings, Penfield, all of N.Y.

[73] Assignee: Eastman Kodak Company, Rochester, N.Y.

[21] Appl. No.: 32,884

[22] Filed: Mar. 18, 1993

[51] Int. Cl.[5] ..... G03G 15/04

[52] U.S. Cl. ..... 430/63; 430/271; 430/527; 430/529; 430/530; 430/631; 430/639; 430/950

[58] Field of Search ..... 430/63, 264, 271, 527, 430/529, 530, 631, 639, 950

[56] References Cited

U.S. PATENT DOCUMENTS 4,275,103 6/1981 Tsubusaki et al. .
4,394,441 7/1983 Kawaguchi et al. .
4,416,963 11/1983 Takimoto et al. .
4,418,141 11/1983 Kawaguchi et al. .
4,431,764 2/1984 Yoshizumi .
4,495,276 1/1985 Takimoto et al. .
4,571,361 2/1986 Kawaguchi et al. .
4,999,276 3/1991 Kuwabara et al. .
5,122,445 6/1992 Ishigaki .

*Primary Examiner*—Jack P. Brammer
*Attorney, Agent, or Firm*—Alfred P. Lorenzo

[57] ABSTRACT

Imaging elements, such as photographic, electrostatographic and thermal imaging elements, are comprised of a support, an image-forming layer and an electrically-conductive layer comprising a film-forming hydrophilic colloid having dispersed therein both electrically-conductive metal-containing particles and water-insoluble polymer particles. The combination of hydrophilic colloid, metal-containing particles and water-insoluble polymer particles provides a controlled degree of electrical conductivity and beneficial chemical, physical and optical properties which adapt the electrically-conductive layer for such purposes as providing protection against static or serving as an electrode which takes part in an image-forming process.

32 Claims, No Drawings

IMAGING ELEMENT COMPRISING AN ELECTRICALLY-CONDUCTIVE LAYER CONTAINING WATER-INSOLUBLE POLYMER PARTICLES

FIELD OF THE INVENTION

This invention relates in general to imaging elements, such as photographic, electrostatographic and thermal imaging elements, and in particular to imaging elements comprising a support, an image-forming layer and an electrically-conductive layer. More specifically, this invention relates to electrically-conductive layers containing water-insoluble polymer particles and to the use of such electrically-conductive layers in imaging elements for such purposes as providing protection against the generation of static electrical charges or serving as an electrode which takes part in an image-forming process.

BACKGROUND OF THE INVENTION

Problems associated with the formation and discharge of electrostatic charge during the manufacture and utilization of photographic film and paper have been recognized for many years by the photographic industry. The accumulation of charge on film or paper surfaces leads to the attraction of dust, which can produce physical defects. The discharge of accumulated charge during or after the application of the sensitized emulsion layer(s) can produce irregular fog patterns or "static marks" in the emulsion. The severity of static problems has been exacerbated greatly by increases in the sensitivity of new emulsions, increases in coating machine speeds, and increases in post-coating drying efficiency. The charge generated during the coating process results primarily from the tendency of webs of high dielectric polymeric film base to charge during winding and unwinding operations (unwinding static), during transport through the coating machines (transport static), and during post-coating operations such as slitting and spooling. Static charge can also be generated during the use of the finished photographic film product. In an automatic camera, the winding of roll film out of and back into the film cassette, especially in a low relative humidity environment, can result in static charging. Similarly, high-speed automated film processing can result in static charge generation. Sheet films are especially subject to static charging during removal from light-tight packaging (e.g., x-ray films).

It is generally known that electrostatic charge can be dissipated effectively by incorporating one or more electrically-conductive "antistatic" layers into the film structure. Antistatic layers can be applied to one or to both sides of the film base as subbing layers either beneath or on the side opposite to the light-sensitive silver halide emulsion layers. An antistatic layer can alternatively be applied as an outer coated layer either over the emulsion layers or on the side of the film base opposite to the emulsion layers or both. For some applications, the antistatic agent can be incorporated into the emulsion layers. Alternatively, the antistatic agent can be directly incorporated into the film base itself.

A wide variety of electrically-conductive materials can be incorporated into antistatic layers to produce a wide range of conductivities. Most of the traditional antistatic systems for photographic applications employ ionic conductors. Charge is transferred in ionic conductors by the bulk diffusion of charged species through an electrolyte. Antistatic layers containing simple inorganic salts, alkali metal salts of surfactants, ionic conductive polymers, polymeric electrolytes containing alkali metal salts, and colloidal metal oxide sols (stabilized by metal salts) have been described previously. The conductivities of these ionic conductors are typically strongly dependent on the temperature and relative humidity in their environment. At low humidities and temperatures, the diffusional mobilities of the ions are greatly reduced and conductivity is substantially decreased. At high humidities, antistatic backcoatings often absorb water, swell, and soften. In roll film, this results in adhesion of the backcoating to the emulsion side of the film. Also, many of the inorganic salts, polymeric electrolytes, and low molecular weight surfactants used are water-soluble and are leached out of the antistatic layers during processing, resulting in a loss of antistatic function.

Antistatic systems employing electronic conductors have also been described. Because the conductivity depends predominantly on electronic mobilities rather than ionic mobilities, the observed electronic conductivity is independent of relative humidity and only slightly influenced by the ambient temperature. Antistatic layers have been described which contain conjugated polymers, conductive carbon particles or semiconductive inorganic particles.

Trevoy (U.S. Pat. No. 3,245,833) has taught the preparation of conductive coatings containing semiconductive silver or copper iodide dispersed as particles less than 0.1 $\mu$m in size in an insulating film-forming binder, exhibiting a surface resistance of $10^2$ to $10^{11}$ ohms per square . The conductivity of these coatings is substantially independent of the relative humidity. Also, the coatings are relatively clear and sufficiently transparent to permit their use as antistatic coatings for photographic film. However, if a coating containing copper or silver iodides was used as a subbing layer on the same side of the film base as the emulsion, Trevoy found (U.S. Pat. No. 3,428,451) that it was necessary to overcoat the conductive layer with a dielectric, water-impermeable barrier layer to prevent migration of semiconductive salt into the silver halide emulsion layer during processing. Without the barrier layer, the semiconductive salt could interact deleteriously with the silver halide layer to form fog and a loss of emulsion sensitivity. Also, without a barrier layer, the semiconductive salts are solubilized by processing solutions, resulting in a loss of antistatic function.

Another semiconductive material has been disclosed by Nakagiri and Inayama (U.S. Pat. No. 4,078,935) as being useful in antistatic layers for photographic applications. Transparent, binderless, electrically semiconductive metal oxide thin films were formed by oxidation of thin metal films which had been vapor deposited onto film base. Suitable transition metals include titanium, zirconium, vanadium, and niobium. The microstructure of the thin metal oxide films is revealed to be nonuniform and discontinuous, with an "island" structure almost "particulate" in nature. The surface resistivity of such semiconductive metal oxide thin films is independent of relative humidity and reported to range from $10^5$ to $10^9$ ohms per square. However, the metal oxide thin films are unsuitable for photographic applications since the overall process used to prepare these thin films is complicated and costly, abrasion resistance of these thin films is low, and adhesion of these thin films to the base is poor.

A highly effective antistatic layer incorporating an "amorphous" semiconductive metal oxide has been disclosed by Guestaux (U.S. Pat. No. 4,203,769). The antistatic layer is prepared by coating an aqueous solution containing a colloidal gel of vanadium pentoxide onto a film base. The colloidal vanadium pentoxide gel typically consists of entangled, high aspect ratio, flat ribbons 50–100 Å wide, about 10 Å thick, and 1,000–10,000 Å long. These ribbons stack flat in the direction perpendicular to the surface when the gel is coated onto the film base. This results in electrical conductivities for thin films of vanadium pentoxide gels (about $1\Omega^{-1}cm-1$) which are typically about three orders of magnitude greater than is observed for similar thickness films containing crystalline vanadium pentoxide particles. In addition, low surface resistivities can be obtained with very low vanadium pentoxide coverages. This results in low optical absorption and scattering losses. Also, the thin films are highly adherent to appropriately prepared film bases. However, vandium pentoxide is soluble at high pH and must be overcoated with a non-permeable, hydrophobic barrier layer in order to survive processing. When used with a conductive subbing layer, the barrier layer must be coated with a hydrophilic layer to promote adhesion to emulsion layers above. (See Anderson et al, U.S. Pat. No. 5,006,451.)

Conductive fine particles of crystalline metal oxides dispersed with a polymeric binder have been used to prepare optically transparent, humidity insensitive, antistatic layers for various imaging applications. Many different metal oxides—such as ZnO, $TiO_2$, $ZrO_2$, $SnO_2$, $Al_2O_3$, $In_2O_3$, $SiO_2$, MgO, BaO, $MoO_3$ and $V_2O_5$—are alleged to be useful as antistatic agents in photographic elements or as conductive agents in electrostatographic elements in such patents as U.S. Pat. Nos. 4,275,103, 4,394,441, 4,416,963, 4,418,141, 4,431,764, 4,495,276, 4,571,361, 4,999,276 and 5,122,445. However, many of these oxides do not provide acceptable performance characteristics in these demanding environments. Preferred metal oxides are antimony doped tin oxide, aluminum doped zinc oxide, and niobium doped titanium oxide. Surface resistivities are reported to range from $10^6$–$10^9$ ohms per square for antistatic layers containing the preferred metal oxides. In order to obtain high electrical conductivity, a relatively large amount (0.1–10 $g/m^2$) of metal oxide must be included in the antistatic layer. This results in decreased optical transparency for thick antistatic coatings. The high values of refractive index (>2.0) of the preferred metal oxides necessitates that the metal oxides be dispersed in the form of ultrafine (<0.1 μm) particles in order to minimize light scattering (haze) by the antistatic layer.

Antistatic layers comprising electro-conductive ceramic particles, such as particles of TiN, $NbB_2$, TiC, $LaB_6$ or MoB, dispersed in a binder such as a water-soluble polymer or solvent-soluble resin are described in Japanese Kokai No. 4/55492, published Feb. 24, 1992.

Fibrous conductive powders comprising antimony-doped tin oxide coated onto non-conductive potassium titanate whiskers have been used to prepare conductive layers for photographic and electrographic applications. Such materials are disclosed, for example, in U.S. Pat. Nos. 4,845,369 and 5,116,666. Layers containing these conductive whiskers dispersed in a binder reportedly provide improved conductivity at lower volumetric concentrations than other conductive fine particles as a result of their higher aspect ratio. However, the benefits obtained as a result of the reduced volume percentage requirements are offset by the fact that these materials are relatively large in size such as 10 to 20 micrometers in length, and such large size results in increased light scattering and hazy coatings.

Use of a high volume percentage of conductive fine particles in an electro-conductive coating to achieve effective antistatic performance results in reduced transparency due to scattering losses and in the formation of brittle layers that are subject to cracking and exhibit poor adherence to the support material. It is thus apparent that it is extremely difficult to obtain non-brittle, adherent, highly transparent, colorless electro-conductive coatings with humidity-independent process-surviving antistatic performance.

The requirements for antistatic layers in silver halide photographic films are especially demanding because of the stringent optical requirements. Other types of imaging elements such as photographic papers and thermal imaging elements also frequently require the use of an antistatic layer but, generally speaking, these imaging elements have less stringent requirements.

Electrically-conductive layers are also commonly used in imaging elements for purposes other than providing static protection. Thus, for example, in electrostatographic imaging it is well known to utilize imaging elements comprising a support, an electrically-conductive layer that serves as an electrode, and a photoconductive layer that serves as the image-forming layer. Electrically-conductive agents utilized as antistatic agents in photographic silver halide imaging elements are often also useful in the electrode layer of electrostatographic imaging elements.

As indicated above, the prior art on electrically-conductive layers in imaging elements is extensive and a very wide variety of different materials have been proposed for use as the electrically-conductive agent. There is still, however, a critical need in the art for improved electrically-conductive layers which are useful in a wide variety of imaging elements, which can be manufactured at reasonable cost, which are resistant to the effects of humidity change, which are durable and abrasion-resistant, which are effective at low coverage, which are adaptable to use with transparent imaging elements, which do not exhibit adverse sensitometric or photographic effects, and which are substantially insoluble in solutions with which the imaging element typically comes in contact, for example, the aqueous alkaline developing solutions used to process silver halide photographic films.

It is toward the objective of providing improved electrically-conductive layers that more effectively meet the diverse needs of imaging elements—especially of silver halide photographic films but also of a wide range of other imaging elements—than those of the prior art that the present invention is directed.

SUMMARY OF THE INVENTION

In accordance with this invention, an imaging element for use in an image-forming process comprises a support, an image-forming layer, and an electrically-conductive layer; the electrically-conductive layer comprising a film-forming hydrophilic colloid having dispersed therein both electrically-conductive metal-containing particles and water-insoluble polymer particles; the electrically-conductive metal-containing particles having an average particle size of less than 0.3 micrometers and constituting about 10 to about 50 volume percent of the electrically-conductive layer, and the water-insoluble polymer particles having an average particle size of from about 10 to about 500 nanometers and being present in the electrically-conductive layer in an amount of from about 0.3 to about 3 parts per part by weight of the film-forming hydrophilic colloid.

The combination of hydrophilic colloid, metal-containing particles and polymer particles provides a controlled degree of electrical conductivity and beneficial chemical, physical and optical properties which adapt the electrically-conductive layer for such purposes as providing protection against static or serving as an electrode which takes part in an image-forming process. Comparable properties cannot be achieved by using only the combination of electrically-conductive metal-containing particles and hydrophilic colloid or the combination of electrically-conductive metal-containing particles and water-insoluble polymer particles. Thus, all three of the components specified are essential to achieving the desired results.

While the exact mechanism whereby the present invention functions is not understood, it is believed that the electrically-conductive layer of this invention is able to provide improved conductivity at a reduced volume percentage of the metal-containing particles by virtue of the action of the polymer. particles in promoting chaining of the metal-containing particles into a conductive network at substantially lower volume fractions than are required in an electrically-conductive layer which does not include the polymer particles. By utilizing lower volume fractions of the metal-containing particles, more transparent and less brittle electrically-conductive layers are obtained, which is highly advantageous for use with imaging elements.

DESCRIPTION OF THE PREFERRED EMBODIMENTS

The imaging elements of this invention can be of many different types depending on the particular use for which they are intended. Such elements include, for example, photographic, electrostatographic, photothermographic, migration, electrothermographic, dielectric recording and thermal-dye-transfer imaging elements.

Photographic elements which can be provided with an antistatic layer in accordance with this invention can differ widely in structure and composition. For example, they can vary greatly in regard to the type of support, the number and composition of the image-forming layers, and the kinds of auxiliary layers that are included in the elements. In particular, the photographic elements can be still films, motion picture films, x-ray films, graphic arts films, paper prints or microfiche. They can be black-and-white elements, color elements adapted for use in a negative-positive process, or color elements adapted for use in a reversal process.

Photographic elements can comprise any of a wide variety of supports. Typical supports include cellulose nitrate film, cellulose acetate film, poly(vinyl acetal) film, polystyrene film, poly(ethylene terephthalate) film, poly(ethylene naphthalate) film, polycarbonate film, glass, metal, paper, polymer-coated paper, and the like. The image-forming layer or layers of the element typically comprise a radiation-sensitive agent, e.g., silver halide, dispersed in a hydrophilic water-permeable colloid. Suitable hydrophilic vehicles include both naturally-occurring substances such as proteins, for example, gelatin, gelatin derivatives, cellulose derivatives, polysaccharides such as dextran, gum arabic, and the like, and synthetic polymeric substances such as water-soluble polyvinyl compounds like poly(vinylpyrrolidone), acrylamide polymers, and the like. A particularly common example of an image-forming layer is a gelatin-silver halide emulsion layer.

In electrostatography an image comprising a pattern of electrostatic potential (also referred to as an electrostatic latent image) is formed on an insulative surface by any of various methods. For example, the electrostatic latent image may be formed electrophotographically (i.e., by imagewise radiation-induced discharge of a uniform potential previously formed on a surface of an electrophotographic element comprising at least a photoconductive layer and an electrically-conductive substrate), or it may be formed by dielectric recording (i.e., by direct electrical formation of a pattern of electrostatic potential on a surface of a dielectric material). Typically, the electrostatic latent image is then developed into a toner image by contacting the latent image with an electrographic developer (if desired, the latent image can be transferred to another surface before development). The resultant toner image can then be fixed in place on the surface by application of heat and/or pressure or other known methods (depending upon the nature of the surface and of the toner image) or can be transferred by known means to another surface, to which it then can be similarly fixed.

In many electrostatographic imaging processes, the surface to which the toner image is intended to be ultimately transferred and fixed is the surface of a sheet of plain paper or, when it is desired to view the image by transmitted light (e.g., by projection in an overhead projector), the surface of a transparent film sheet element.

In electrostatographic elements, the electrically-conductive layer can be a separate layer, a part of the support layer or the support layer. There are many types of conducting layers known to the electrostatographic art, the most common being listed below:

(a) metallic laminates such as an aluminum-paper laminate,
(b) metal plates, e.g., aluminum, copper, zinc, brass, etc.,
(c) metal foils such as aluminum foil, zinc foil, etc.,
(d) vapor deposited metal layers such as silver, aluminum, nickel, etc.,
(e) semiconductors dispersed in resins such as poly(ethylene terephthalate) as described in U.S. Pat. No. 3,245,833,
(f) electrically conducting salts such as described in U.S. Pat. Nos. 3,007,801 and 3,267,807.

Conductive layers (d), (e) and (f) can be transparent and can be employed where transparent elements are required, such as in processes where the element is to be exposed from the back rather than the front or where the element is to be used as a transparency.

Thermally processable imaging elements, including films and papers, for producing images by thermal processes are well known. These elements include thermographic elements in which an image is formed by imagewise heating the element. Such elements are described in, for example, *Research Disclosure,* June 1978, Item No. 17029; U.S. Pat. No. 3,457,075; U.S. Pat. No. 3,933,508; and U.S. Pat. No. 3,080,254.

Photothermographic elements typically comprise an oxidation-reduction image-forming combination which contains an organic silver salt oxidizing agent, preferably a silver salt of a long-chain fatty acid. Such organic silver salt oxidizing agents are resistant to darkening upon illumination. Preferred organic silver salt oxidizing agents are silver salts of long-chain fatty acids containing 10 to 30 carbon atoms. Examples of useful organic silver salt oxidizing agents are silver behenate, silver stearate, silver oleate, silver laurate, silver hydroxystearate, silver caprate, silver myristate and silver palmitate. Combinations of organic silver salt oxidizing agents are also useful. Examples of useful silver salt oxidizing agents which are not silver salts of long-chain fatty acids include, for example, silver benzoate and silver benzotriazole.

Photothermographic elements also comprise a photosensitive component which consists essentially of photographic silver halide. In photothermographic materials it is believed that the latent image silver from the silver halide acts as a catalyst for the oxidation-reduction image-forming combination upon processing. A preferred concentration of photographic silver halide is within the range of about 0.01 to about 10 moles of photographic silver halide per mole of organic silver salt oxidizing agent, such as per mole of silver behenate, in the photothermographic material. Other photosensitive silver salts are useful in combination with the photographic silver halide if desired. Preferred photographic silver halides are silver chloride, silver bromide, silver bromoiodide, silver chlorobromoiodide and mixtures of these silver halides. Very fine grain photographic silver halide is especially useful.

Migration imaging processes typically involve the arrangement of particles on a softenable medium. Typically, the medium, which is solid and impermeable at room temperature, is softened with heat or solvents to permit particle migration in an imagewise pattern.

As disclosed in R.W. Gundlach, "Xeroprinting Master with Improved Contrast Potential", *Xerox Disclosure Journal,* Vol. 14, No. 4, July/August 1984, pages 205–06, migration imaging can be used to form a xeroprinting master element. In this process, a monolayer of photosensitive particles is placed on the surface of a layer of polymeric material which is in contact with a conductive layer. After charging, the element is subjected to imagewise exposure which softens the polymeric material and causes migration of particles where such softening occurs (i.e., image areas). When the element is subsequently charged and exposed, the image areas (but not the non-image areas) can be charged, developed, and transferred to paper.

Another type of migration imaging technique, disclosed in U.S. Pat. No. 4,536,457 to Tam, U.S. Pat. No. 4,536,458 to Ng, and U.S. Pat. No. 4,883,731 to Tam et al, utilizes a solid migration imaging element having a substrate and a layer of softenable material with a layer of photosensitive marking material deposited at or near the surface of the softenable layer. A latent image is formed by electrically charging the member and then exposing the element to an imagewise pattern of light to discharge selected portions of the marking material layer. The entire softenable layer is then made permeable by application of the marking material, heat or a solvent, or both. The portions of the marking material which retain a differential residual charge due to light exposure will then migrate into the softened layer by electrostatic force.

An imagewise pattern may also be formed with colorant particles in a solid imaging element by establishing a density differential (e.g., by particle agglomeration or coalescing) between image and non-image areas. Specifically, colorant particles are uniformly dispersed and then selectively migrated so that they are dispersed to varying extents without changing the overall quantity of particles on the element.

Another migration imaging technique involves heat development, as described by R.M. Schaffert, *Electrophotography,* (Second Edition, Focal Press, 1980), pp. 44–47 and U.S. Pat. No. 3,254,997. In this procedure, an electrostatic image is transferred to a solid imaging element, having colloidal pigment particles dispersed in a heat-softenable resin film on a transparent conductive substrate. After softening the film with heat, the charged colloidal particles migrate to the oppositely charged image. As a result, image areas have an increased particle density, while the background areas are less dense.

An imaging process known as "laser toner fusion", which is a dry electrothermographic process, is also of significant commercial importance. In this process, uniform dry powder toner depositions on non-photosensitive films, papers, or lithographic printing plates are imagewise exposed with high power (0.2–0.5 W) laser diodes thereby, "tacking" the toner particles to the substrate(s). The toner layer is made, and the non-imaged toner is removed, using such techniques as electrographic "magnetic brush" technology similar to that found in copiers. A final blanket fusing step may also be needed, depending on the exposure levels.

Another example of imaging elements which employ an antistatic layer are dye-receiving elements used in thermal dye transfer systems.

Thermal dye transfer systems are commonly used to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are described in U.S. Pat. No. 4,621,271.

In EPA No. 194,106, antistatic layers are disclosed for coating on the back side of a dye-receiving element. Among the materials disclosed for use are electrically-conductive inorganic powders such as a "fine powder of titanium oxide or zinc oxide."

Another type of image-forming process in which the imaging element can make use of an electrically-conductive layer is a process employing an imagewise exposure to electric current of a dye-forming electrically-activatable recording element to thereby form a developable image followed by formation of a dye image, typically by means of thermal development. Dye-forming electrically activatable recording elements and processes are well known and are described in such patents as U.S. Pat. No. 4,343,880 and U.S. Pat. No. 4,727,008.

In the imaging elements of this invention, the image-forming layer can be any of the types of image-forming layers described above, as well as any other image-forming layer known for use in an imaging element.

All of the imaging processes described hereinabove, as well as many others, have in common the use of an electrically-conductive layer as an electrode or as an antistatic layer. The requirements for a useful electrically-conductive layer in an imaging environment are extremely demanding and thus the art has long sought to develop improved electrically-conductive layers exhibiting the necessary combination of physical, optical and chemical properties.

As described hereinabove, the imaging elements of this invention include an electrically-conductive layer comprising a film-forming hydrophilic colloid having dispersed therein both electrically-conductive metal-containing particles and water-insoluble polymer particles.

The use of film-forming hydrophilic colloids in imaging elements is very well known. The most commonly used of these is gelatin and gelatin is a particularly preferred material for use in this invention.

Hydrophilic colloids that are useful in the electrically-conductive layer of this invention are the same as are useful in silver halide emulsion layers, some of which have been described hereinabove. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly(vinylpyrrolidone), and the like.

Any of the wide diversity of electrically-conductive metal-containing particles proposed for use heretofore in imaging elements can be used in the electrically-conductive layer of this invention. Examples of useful electrically-conductive metal-containing particles include donor-doped metal oxides, metal oxides containing oxygen deficiencies, and conductive nitrides, carbides or borides. Specific examples of particularly useful particles include conductive $TiO_2$, $SnO_2$, $Al_2O_3$, $ZrO_2$, $In_2O_3$, ZnO, $TiB_2$, $ZrB_2$, $NbB_2$, $TaB_2$, $CrB_2$, MoB, WB, $LaB_6$, ZrN, TiN, TiC, WC, HfC, HfN and ZrC.

Particular preferred metal oxides for use in this invention are antimony-doped tin oxide, aluminum-doped zinc oxide and niobium-doped titanium oxide.

In the imaging elements of this invention, it is preferred that the electrically-conductive metal-containing particles have an average particle size of less than 0.3 micrometers and particularly preferred that they have an average particle size of less than 0.1 micrometers. It is also advantageous that the electrically-conductive metal-containing particles exhibit a powder resistivity of $10^5$ ohm-centimeters or less.

It is an important feature of this invention that it permits the achievement of high levels of electrical conductivity with the use of relatively low volumetric fractions of the metal-containing particles. Accordingly, in the imaging elements of this invention, the electrically-conductive metal-containing particles constitute about 10 to about 50 volume percent of the electrically-conductive layer. Use of significantly less than 10 volume percent of the electrically-conductive metal-containing particles will not provide a useful degree of electrical conductivity. On the other hand, use of significantly more than 50 volume percent of the electrically-conductive metal-containing particles defeats the objectives of the invention in that it results in reduced transparency due to scattering losses and in brittle layers which are subject to cracking and exhibit poor adherence to the support material. It is especially preferred to utilize the electrically-conductive metal-containing particles in an amount of from 15 to 35 volume percent of the electrically-conductive layer.

Polymer particles utilized in this invention must be water-insoluble. They are conveniently prepared by emulsion polymerization of ethylenically unsaturated monomers or by post emulsification of preformed polymers. In the latter case, the preformed polymer is first dissolved in an organic solvent and the resulting solution is emulsified in an aqueous media in the presence of an appropriate emulsifier. Representative polymer particles useful in this invention include polymers of styrene, derivatives of styrene, alkyl acrylates, derivatives of alkyl acrylates, alkyl methacrylates, derivatives of alkyl methacrylates, olefins, vinylidene chloride, acrylonitrile, acrylamide, derivatives of acylamide, methacrylamide, derivatives of methacrylamide, vinyl esters, vinyl ethers, and urethanes. The glass transition temperature (Tg) of the polymer particles is not critical and can vary widely.

It is preferred that the water-insoluble polymer particles utilized in this invention have a refractive index in the range of from about 1.3 to about 1.7 and particularly preferred that they have a refractive index in the range of from 1.4 to 1.6. Close matching of the refractive index of the polymer particles to that of the film-forming hydrophilic colloid is beneficial in reducing light scattering.

To perform their function of promoting chaining of the metal-containing particles into a conductive network at low volume fractions it is essential that the polymer particles be of very small size. Useful polymer particles are those having an average particle size of from about 10 to about 500 nanometers, while preferred polymer particles are those having an average particle size of from 20 to 300 nanometers.

Incorporation in the electrically-conductive layer of water-insoluble polymer particles of very small size, as described herein, is of particular benefit with electrically-conductive metal-containing particles that are more or less spherical in shape. It is of less benefit with electrically-conductive metal-containing particles that are fibrous in character, since fibrous particles are much more readily able to form a conductive network without the aid of the polymer particles.

It is important that the water-insoluble polymer particles be utilized in an effective amount in relation to the amount of hydrophilic colloid employed. Useful amounts are from about 0.3 to about 3 parts per part by weight of the film-forming hydrophilic colloid, while preferred amounts are from 0.5 to 2 parts per part by weight of the film-forming hydrophilic colloid. Use of too small an amount of the polymer particles will prevent them from performing the desired function of promoting chaining of the metal-containing particles into a conductive network, while use of too large an amount of the polymer particles will result in the formation of an electrically-conductive layer to which other layers of imaging elements may not adequately adhere.

In the electrically-conductive layer of this invention, the film-forming hydrophilic colloid forms the continuous phase and both the polymer particles and the metal-containing particles are dispersed therein. All three of these ingredients are essential to achieving the desired result. The electrically-conductive layer can also contain a wide variety of other ingredients such as wetting aids, matte particles, biocides, dispersing aids, hardeners, antihalation dyes, and the like. The electrically-conductive layer of this invention adheres strongly to conventional support materials employed in imaging elements as well as to underlying or overlying hydrophilic colloid layers.

The electrically-conductive layer of this invention typically has a surface resistivity of less than $1\times10^{11}$ ohms/square, and preferably of less than $1\times10^{10}$ ohms/square.

The electrically-conductive layer can be applied at any suitable coverage depending on the requirements of the imaging element involved. For photographic silver halide films, typical coverages utilized are dry coating weights of from about 100 to about 1500 mg/m$^2$.

One of the most difficult problems to overcome in using electrically-conductive layers in imaging elements is the tendency of layers which are coated over the electrically-conductive layer to seriously reduce the electro-conductivity. Thus, for example, a layer consisting of conductive tin oxide particles dispersed in gelatin will exhibit a substantial loss of conductivity after it is overcoated with other layers such as a silver halide emulsion layer or anti-curl layer. This loss in conductivity can be overcome by utilizing increased volumetric concentrations of tin oxide but this leads to less transparent coatings and serious adhesion problems. In marked contrast, the electrically-conductive layers of this invention, which contain water-insoluble polymer particles, retain a much higher proportion of their conductivity after being overcoated with other layers.

Particularly useful imaging elements within the scope of this invention are those in which the support is a transparent polymeric film, the image-forming layer is comprised of silver halide grains dispersed in gelatin, the film-forming hydrophilic colloid in the electrically-conductive layer is gelatin, the electrically-conductive metal-containing particles are antimony-doped tin oxide particles, the electrically-conductive layer has a surface resistivity of less than $1\times10^{10}$ ohms/square and the electrically-conductive layer has a UV-density of less than 0.015.

An antistatic layer as described herein can be applied to a photographic film support in various configurations depending upon the requirements of the specific photographic application. In the case of photographic elements for graphics arts applications, an antistatic layer can be applied to a polyester film base during the support manufacturing process after orientation of the cast resin and coating thereof with a polymer undercoat layer. The antistatic layer can be applied as a subbing layer on the sensitized emulsion side of the support, on the side of the support opposite the emulsion or on both sides of the support. When the antistatic layer is applied as a subbing layer on the same side as the sensitized emulsion, it is not necessary to apply any intermediate layers such as barrier layers or adhesion promoting layers between it and the sensitized emulsion, although they can optionally be present. Alternatively, the antistatic layer can-be applied as part of a multi-component curl control layer on the side of the support opposite to the sensitized emulsion during film sensitizing. The antistatic layer would typically be located closest to the support. An intermediate layer, containing primarily binder and antihalation dyes functions as an antihalation layer. The outermost layer typically contains binder, matte, and surfactants and functions as a protective overcoat layer. The outermost layer can, if desired, serve as the antistatic layer. Additional addenda, such as polymer latexes to improve dimensional stability, hardeners or cross linking agents, and various other conventional additives as well as conductive particles can be present in any or all of the layers.

In the case of photographic elements for direct or indirect x-ray applications, the antistatic layer can be applied as a subbing layer on either side or both sides of the film support. In one type of photographic element, the antistatic subbing layer is applied to only one side of the support and the sensitized emulsion coated on both sides of the film support. Another type of photographic element contains a sensitized emulsion on only one side of the support and a pelloid containing gelatin on the opposite side of the support. An antistatic layer can be applied under the sensitized emulsion or, preferably, the pelloid. Additional optional layers can be present. In another photographic element for x-ray applications, an antistatic subbing layer can be applied either under or over a gelatin subbing layer containing an antihalation dye or pigment. Alternatively, both antihalation and antistatic functions can be combined in a single layer containing conductive particles, antihalation dye, and a binder. This hybrid layer can be coated on one side of a film support under the sensitized emulsion.

Specific examples of water-insoluble polymer particles that are especially useful in the imaging elements of this invention include the polymers listed in Table 1 below.

TABLE 1

| Polymer | Description | Tg (°C.) | Average Particle Diameter (nm) |
|---|---|---|---|
| P-1 | styrene/n-butyl methacrylate/2-sulfoethyl methacrylate sodium salt (30/60/10/latex) | 41 | 73 |
| P-2 | methyl acrylate/vinylidene chloride/itaconic acid (15/83/2 latex) | 24 | 87 |
| P-3 | butyl acrylate/2-sulfo-1,1-dimethylethyl acrylamide sodium salt (95/5 latex) | −20 | 61 |
| P-4 | polymethyl methacrylate | 105 | 55 |
| P-5 | butyl acrylate/methacrylic acid/hydroxyethylmethacrylate (75/10/15 latex) | 22 | 260 |
| P-6 | styrene/butadiene (50/50 latex) | 10 | 125 |

Polymer P-1, a latex interpolymer having the composition 30 mol % styrene, 60 mol % n-butyl methacrylate and 10 mol % sodium 2-sulfoethyl methacrylate, was prepared in accordance with the procedure described below. The other polymers listed in Table 1 can be prepared by analogous methods.

To a one-liter addition flask, there was added 225 milliliters of degassed distilled water, 14 milliliters of a 45% solution in water of a branched $C_{12}$ alkylated disulfonated diphenyloxide surfactant available from Dow Chemical Company under the trademark DOWFAX 2A1, 68.9 grams of styrene, 188 grams of n-butyl methacrylate and 42.8 grams of sodium 2-sulfoethyl methacrylate. The mixture was stirred under nitrogen. To a two-liter reaction flask there was added 475 milliliters of degassed distilled water and 14 milliliters of a 45% solution in water of DOWFAX 2A1 surfactant. The reaction flask was placed in an 80° C. bath and 3.0 grams of potassium persulfate and 1 gram of sodium metabisulfite were added, immediately followed by the contents of the addition flask over a period of 40 minutes. The flask was stirred at 80° C. under nitrogen for two hours and then cooled. The pH of the latex was adjusted to 7 with 10% sodium hydroxide. The latex was filtered to remove a small amount of coagulum resulting in a product with 30% solids. As reported in Table 1, the polymer had a glass transition temperature of 41° C. and an average particle diameter of 73 nanometers.

The invention is further illustrated by the following examples of its practice.

EXAMPLES 1–6

Electrically-conductive coatings were prepared which were comprised of a gelatin binder having dispersed therein particles of polymer P-1 and conductive particles of tin oxide doped with 6% antimony and having an average particle size of 70 nanometers. The electrically-conductive coatings were prepared by hopper coating an aqueous composition containing 2 weight percent total solids on a 4-mil thick polyethylene terephthalate film support that had been subbed with a terpolymer latex of acrylonitrile, vinylidene chloride and acrylic acid. The aqueous coating composition was coated in an amount to provide a total dry coverage of 500 mg/m$^2$ and dried at 120° C. The volume percentage of tin oxide in the dry coating and the ratio of polymer P-1 to gelatin binder are reported in Table 2 for each of Examples 1 to 6. Table 2 also reports the surface resistivity of the coatings, which was measured at 20% relative humidity using a two-point probe, and a qualitative assessment of the coating quality. For purposes of comparison, results are also reported for Comparative Examples A to H in which either the tin oxide particles or the polymer particles or both were omitted.

TABLE 2

| Example No. | Polymer | Weight Ratio of Polymer to Gelatin | Volume % $SnO_2$ | Surface Resistivity (ohms/square) | Coating Quality |
|---|---|---|---|---|---|
| 1 | P-1 | 1:2 | 15 | $1.7 \times 10^{10}$ | Excellent |
| 2 | P-1 | 1:1 | 15 | $5.4 \times 10^{9}$ | Excellent |
| 3 | P-1 | 2:1 | 15 | $1.7 \times 10^{9}$ | Excellent |
| 4 | P-1 | 1:2 | 25 | $3.4 \times 10^{8}$ | Excellent |
| 5 | P-1 | 1:1 | 25 | $1.7 \times 10^{8}$ | Excellent |
| 6 | P-1 | 2:1 | 25 | $1.3 \times 10^{8}$ | Excellent |
| A | None | — | 0 | $3.5 \times 10^{13}$ | Excellent |
| B | None | — | 15 | $3.5 \times 10^{12}$ | Excellent |
| C | None | — | 25 | $8.6 \times 10^{10}$ | Excellent |
| D | None | — | 40 | $8.5 \times 10^{8}$ | Cracks |
| E | None | — | 75 | $5.3 \times 10^{8}$ | Severe Cracks |
| F | P-1 | 1:2 | 0 | $1.1 \times 10^{14}$ | Excellent |
| G | P-1 | 1:1 | 0 | $1.1 \times 10^{14}$ | Excellent |
| H | P-1 | 2:1 | 0 | $1.1 \times 10^{14}$ | Excellent |

Considering the data in Table 2, it is seen that each of Examples 1 to 6 provided good electro-conductivity, as demonstrated by the surface resistivity values reported, and excellent coating quality. Comparative Example A, which contained neither polymer particles nor tin oxide particles did not provide a level of electro-conductivity that is useful in imaging elements. Comparative Examples B to E, in which the polymer particles were omitted, demonstrate an increasing level of electro-conductivity as the volume percentage of tin oxide was increased from 15 to 75 percent. However, at a tin oxide content of only 15 percent the level of electro-conductivity was inadequate while at a tin oxide content of 75 percent the physical properties of the coating were unacceptable for use in imaging elements. Comparative Examples F to H, in which the tin oxide was omitted, were similar to Comparative Example A in that they did not provide a useful level of electro-conductivity. The beneficial effect of including the polymer particles in the electrically-conductive layer can be seen by comparing Example 3, which provided a surface resistivity of $1.7 \times 10^9$ ohms/square with 15 volume % $SnO_2$, with Comparative Example B, which provided a surface resistivity of $3.5 \times 10^{12}$ ohms/square at the same 15% by volume concentration of $SnO_2$. It can also be seen by comparing Example 6, which provided a surface resistivity of $1.3 \times 10^8$ ohms/square with 25 volume % of $SnO_2$, with Comparative Example C, which provided a surface resistivity of $8.6 \times 10^{10}$ ohms/square at the same 25% by volume concentration of $SnO_2$. These results indicate that inclusion of water-insoluble polymer particles in the electrically-conductive layer in accordance with this invention provides a level of electro-conductivity that is hundreds of times greater, at the same concentration of metal-containing particles, than is achieved when the water-insoluble polymer particles are omitted.

EXAMPLES 7–9

In the same manner described in Examples 1–6, electrically-conductive coatings were prepared in which polymer P-3 was incorporated therein. The volume percentage of tin oxide, the ratio of polymer P-3 to gelatin, the surface resistivity and the coating quality are reported in Table 3 below.

Also included in Table 3 are Comparative Examples I, J and K in which water-soluble polyacrylamide, designated polymer P-7, was used in place of the water-insoluble polymer particles required in this invention.

TABLE 3

| Example No. | Polymer | Weight Ratio of Polymer to Gelatin | Volume % $SnO_2$ | Surface Resistivity (ohms/square) | Coating Quality |
|---|---|---|---|---|---|
| 7 | P-3 | 1:2 | 25 | $3.4 \times 10^{9}$ | Excellent |
| 8 | P-3 | 1:1 | 25 | $4.3 \times 10^{9}$ | Excellent |

TABLE 3-continued

| Example No. | Polymer | Weight Ratio of Polymer to Gelatin | Volume % $SnO_2$ | Surface Resistivity (ohms/square) | Coating Quality |
|---|---|---|---|---|---|
| 9 | P-3 | 2:1 | 25 | $1.3 \times 10^9$ | Excellent |
| I | P-7 | 1:2 | 25 | $1.1 \times 10^{14}$ | Slight Haze |
| J | P-7 | 1:1 | 25 | $1.1 \times 10^{14}$ | Slight Haze |
| K | P-7 | 2:1 | 25 | $1.1 \times 10^{14}$ | Excellent |

As indicated by the data in Table 3, use of polymer P-3 gave excellent electro-conductivity and excellent coating quality at all ratios of polymer to gelatin evaluated. Omitting gelatin from the composition, so that it contained only polymer P-3 and $SnO_2$ gave an electrically-conductive layer of excellent quality with a surface resistivity of $8.5 \times 10^9$ ohms/square. However, the use of such a layer is highly disadvantageous in imaging elements in that overlying hydrophilic colloid layers, such as silver halide emulsion layers containing gelatin as a binder, will not adhere to the electrically-conductive layer.

Comparative Examples I, J and K demonstrate that a blend of water-soluble polyacrylamide and gelatin does not give the high levels of electro-conductivity that are obtained by use of a combination of gelatin and water-insoluble polymer particles. Omitting gelatin from the composition so that it contained only polyacrylamide and $SnO_2$ gave an electrically-conductive layer of excellent quality with a surface resistivity of $3.4 \times 10^{11}$. This however is a much lower level of electro-conductivity than was obtained in Example 6 at the same 25 volume % level of $SnO_2$.

EXAMPLES 10–16

In the same manner described in Examples 1–6, electro-conductive coatings were prepared in which polymers P-4, P-5 or P-6 were incorporated therein. The volume percentage of tin oxide, the ratio of polymer to gelatin, the surface resistivity and the coating quality are reported in Table 4 below.

TABLE 4

| Example No. | Polymer | Weight Ratio of Polymer to Gelatin | Volume % $SnO_2$ | Surface Resistivity (ohms/square) | Coating Quality |
|---|---|---|---|---|---|
| 10 | P-4 | 1:2 | 25 | $4.3 \times 10^9$ | Slight Haze |
| 11 | P-4 | 1:1 | 25 | $5.3 \times 10^8$ | Slight Haze |
| 12 | P-4 | 2:1 | 25 | $8.5 \times 10^8$ | Good |
| 13 | P-5 | 1:2 | 25 | $5.4 \times 10^{10}$ | Slight Haze |
| 14 | P-6 | 1:2 | 25 | $3.4 \times 10^9$ | Good |
| 15 | P-6 | 1:1 | 25 | $1.1 \times 10^9$ | Good |
| 16 | P-6 | 2:1 | 25 | $6.7 \times 10^8$ | Good |

As indicated by the data in Table 4, use of any one of polymers P-4, P-5 or P-6 in combination with gelatin gave an acceptable level of electro-conductivity. Coatings were also prepared using polymers P-4, P-5 and P-6 but omitting gelatin. Use of polymer P-4 gave a coating of excellent quality with a surface resistivity of $5.4 \times 10^9$ ohms/square use of polymer P-5 gave a coating of excellent quality with a surface resistivity of $1.7 \times 10^9$ ohms/square and use of polymer P-6 gave a coating of good quality with a surface resistivity of $1.7 \times 10^9$ ohms/square. However, coatings which do not contain gelatin, or other film-forming hydrophilic colloid, exhibit serious problems with respect to adhesion of overlying hydrophilic colloid layers, such as silver halide emulsion layers and anticurl layers.

EXAMPLES 17–19

In the same manner as described in Examples 1–6, electro-conductive coatings were prepared in which polymer P-2 was incorporated therein. Table 5 below describes the volume percentage of tin oxide, the ratio of polymer P-2 to gelatin, the dry coating weight in milligrams per square meter, the surface resistivity at 20% relative humidity and the UV density. UV densities were measured with an X-Rite Model 361T densitometer and the values reported are the difference in the UV density between uncoated 4-mil thick film support and the same film support coated with the electrically-conductive layer.

Also included in Table 5 are Comparative Examples L, M, N and 0 in which polymer P-2 was omitted.

TABLE 5

| Example No. | Polymer | Weight Ratio of Polymer to Gelatin | Volume % $SnO_2$ | Dry Coating Weight ($mg/m^2$) | Surface Resistivity (ohms/square) | UV Density |
|---|---|---|---|---|---|---|
| 17 | P-2 | 1:2 | 25 | 500 | $5.4 \times 10^9$ | 0.011 |
| 18 | P-2 | 1:1 | 25 | 500 | $1.1 \times 10^9$ | 0.010 |
| 19 | P-2 | 2:1 | 25 | 500 | $2.1 \times 10^8$ | 0.009 |
| L | None | — | 25 | 500 | $2.2 \times 10^{11}$ | 0.015 |
| M | None | — | 35 | 700 | $1.1 \times 10^{10}$ | 0.019 |
| N | None | — | 50 | 500 | $2.4 \times 10^9$ | 0.016 |
| O | None | — | 50 | 700 | $6.0 \times 10^8$ | 0.019 |

Considering the data in Table 5, it is seen that each of Examples 17 to 19 provided good electro-conductivity and relatively low values for UV density. Comparative Example L demonstrates that at the same concentration of $SnO_2$ as was used in Examples 17 to 19, both electro-conductivity and transparency were significantly inferior when the water-insoluble polymer particles were omitted. Examples M, N and O demonstrate that increasing the concentration of $SnO_2$ improves electro-conductivity but adversely affects transparency.

EXAMPLES 20–27

In the same manner as described in Examples 1–6, electrically-conductive coatings were prepared in which polymers P-1, P-2, P-3, P-4, P-5 and P-6 were incorporated. The electro-conductive coatings were overcoated with a gelatin layer containing bis(vinyl methyl) sulfone hardener in order to simulate overcoating with a photographic emulsion layer or curl control layer. The gelatin overcoat was chill set at 15° C. and dried at 40° C. to give a dry coating weight of 4500 mg/m$^2$. The internal resistivity of the overcoated samples was measured at 20% relative humidity using the salt bridge method. Dry adhesion of the gelatin overcoat to the electrically-conductive layer was determined by scribing small hatch marks in the coating with a razor blade, placing a piece of high tack tape over the scribed area and then quickly pulling the tape from the surface. The amount of the scribed area removed is a measure of the dry adhesion. Wet adhesion for the samples was tested by placing the test samples in developing and fixing solutions at 35° C. each and then rinsing in distilled water. While still wet, a one millimeter wide line was scribed in the gelatin overcoat layer and a finger was rubbed vigorously across the scribe line. The width of the line after rubbing was compared to that before rubbing to give a measure of wet adhesion. The permanence of the antistatic properties after film processing was determined by tray processing the samples in developing and fixing solutions as described above for the wet adhesion tests, drying the samples at 50° C., and measuring the internal resistivity at 20% relative humidity.

Table 6 below describes the volume percentage of tin oxide, the ratio of polymer to binder, the resistivity before overcoating, the resistivity after overcoating, the resistivity after processing, the wet adhesion and the dry adhesion.

Also included in Table 6 are Comparative Examples P, Q and R in which the polymer was omitted and Comparative Examples S, T and U in which water-soluble polyacrylamide, designated polymer P-7, was used in place of the water-insoluble polymer particles required in this invention.

TABLE 6

| Example No. | Polymer | Weight Ratio of Polymer to Gelatin | Volume % $SnO_2$ | Resistivity Before Overcoating (ohms/square) | Resistivity After Overcoating (ohms/square) | Resistivity After Processing (ohms/square) | Wet Adhesion | Dry Adhesion |
|---|---|---|---|---|---|---|---|---|
| 20 | P-1 | 1:2 | 25 | $3.4 \times 10^8$ | $5.00 \times 10^{10}$ | $2.50 \times 10^{10}$ | Excellent | Excellent |
| 21 | P-1 | 1:1 | 25 | $1.70 \times 10^8$ | $5.00 \times 10^9$ | $2.50 \times 10^9$ | Excellent | Excellent |
| 22 | P-1 | 2:1 | 25 | $1.30 \times 10^8$ | $1.20 \times 10^9$ | $4.00 \times 10^8$ | Excellent | Excellent |
| 23 | P-2 | 2:1 | 25 | $2.10 \times 10^8$ | $1.08 \times 10^{10}$ | $5.43 \times 10^{10}$ | Excellent | Excellent |
| 24 | P-3 | 2:1 | 25 | $1.30 \times 10^9$ | $4.34 \times 10^{11}$ | $6.89 \times 10^{11}$ | Good | Good |
| 25 | P-4 | 2:1 | 25 | $8.50 \times 10^8$ | $5.39 \times 10^9$ | $8.55 \times 10^9$ | Good | Good |
| 26 | P-5 | 1:2 | 25 | $5.40 \times 10^{12}$ | $1.09 \times 10^{12}$ | $1.73 \times 10^{12}$ | Good | Excellent |
| 27 | P-6 | 2:1 | 25 | $6.70 \times 10^8$ | $6.84 \times 10^{10}$ | $5.43 \times 10^{10}$ | Excellent | Excellent |
| P | None | — | 25 | $8.60 \times 10^{10}$ | $1.00 \times 10^{14}$ | $1.00 \times 10^{14}$ | Excellent | Excellent |
| Q | None | — | 50 | $5.00 \times 10^8$ | $1.00 \times 10^{10}$ | $5.00 \times 10^9$ | Good | Excellent |
| R | None | — | 75 | $1.00 \times 10^8$ | $1.10 \times 10^8$ | $1.00 \times 10^8$ | Poor | Good |
| S | P-7 | 1:2 | 25 | $>1.10 \times 10^{14}$ | $>1.10 \times 10^{14}$ | $>1.10 \times 10^{14}$ | * | * |
| T | P-7 | 1:1 | 25 | $>1.10 \times 10^{14}$ | $>1.10 \times 10^{14}$ | $>1.10 \times 10^{14}$ | * | * |
| U | P-7 | 2:1 | 25 | $>1.10 \times 10^{14}$ | $>1.10 \times 10^{14}$ | $>1.10 \times 10^{14}$ | * | * |

*Not Measured.

As indicated by the data in Table 6, use of any one of the polymers P-1 to P-6 in combination with gelatin gave good electro-conductive properties before the overcoat was applied, after the overcoat was applied and after processing was carried out. They also gave acceptable wet adhesion and dry adhesion characteristics. Comparative Example P, in which the water-insoluble polymer particles were omitted, gave unacceptable electro-conductivity after overcoating and after processing. Increasing the concentration of tin oxide in Comparative Examples Q and R gave improved electro-conductive characteristics but adversely affected both wet and dry adhesion. Comparative Examples S, T and U demonstrate that use of water-soluble polyacrylamide in place of the water-insoluble polymer particles required in this invention gave unacceptable electro-conductive characteristics.

An electrically-conductive layer which contained polymer P-1 and 25 volume % $SnO_2$, i.e., in which gelatin was omitted, exhibited a resistivity before overcoating of $1.10 \times 10^8$ ohms/square, a resistivity after overcoating of $1.20 \times 10^8$ ohms/square but had both poor wet adhesion and poor dry adhesion. An electrically-conductive layer which contained polymer P-7 and 25 volume % of $SnO_2$, i.e., in which gelatin was omitted, exhibited a resistivity before overcoating of $3.40 \times 10^{11}$ ohms/square, a resistivity after overcoating of $>1.10 \times 10^{14}$ ohms/square, and a resistivity after processing of $>1.10 \times 10^{14}$ ohms/square.

It is apparent from the data in Table 6, that electrically-conductive coatings such as that of Comparative Example Q which contain 50 volume % of $SnO_2$ dispersed in gelatin but no water-insoluble polymer particles undergo a substantial loss in electro-conductivity after being overcoated, i.e., an increase in resistivity from $5.00 \times 10^8$ to $1.00 \times 10^{10}$ ohms/square. This loss in electro-conductivity can be overcome by increasing the volume percentage of the electrically-conductive particles, as in Comparative Example R, but this leads to less transparent coatings and poor adhesion. Coatings containing 25 volume % of electrically-conductive particles, water-insoluble polymer particles and gelatin, such as those of Examples 20 to 27, provide resistivities after overcoating which are 3 to 5 orders of magnitude superior to electrically-conductive coatings, such as that of Comparative Example P, which only contain gelatin. Electrically-conductive coatings which contain a hydrophilic colloid, such as gelatin, having dispersed therein both electrically-conductive metal-containing particles and water-insoluble polymer particles, as required by this invention, also provide excellent adhesion to overlying layers such as photographic emulsion layers or curl control layers.

COMPARATIVE EXAMPLE V

To further demonstrate the benefits of water-insoluble polymer particles in the imaging elements of this invention, a poly(ethylene terephthalate) film support was coated at a dry coverage of 500 mg/m$^2$ with an electrically-conductive layer comprised of gelatin, water-soluble poly(sodium styrene sulfonate-co-hydroxyethyl methacrylate, 60/40) and antimony-doped $SnO_2$. The volume percentage of $SnO_2$ was 25% and the weight ratio of polymer to gelatin was 1 to 1. The electrically-conductive layer had a surface resistivity at 20% relative humidity of $4\times10^{10}$ ohms/square but after overcoating with a gelatin overcoat the internal resistivity, at 20% relative humidity, was in excess of $5\times10^{13}$ ohms/square. Thus, electrically-conductive layers comprising water-soluble polymers undergo a major loss in electro-conductivity upon being overcoated with gelatin layers, in marked contrast to the results achieved with water-insoluble polymer particles as described hereinabove.

The imaging elements of this invention exhibit many advantages in comparison with similar imaging elements known heretofore. For example, because they are able to utilize relatively low concentrations of the electrically-conductive metal-containing particles they have excellent transparency characteristics and they are free from the problems of excessive brittleness and poor adhesion that have plagued similar imaging elements in the prior art. Also, because they are able to employ electrically-conductive metal-containing particles of very small size they avoid the problems caused by the use of fibrous particles of greater size, such as increased light scattering and the formation of hazy coatings. It has been proposed heretofore to incorporate non-conductive auxiliary fine particles such as oxides, sulfates or carbonates in electrically-conductive layers comprised of metal-containing particles dispersed in a binder (see for example, U.S. Pat. No. 4,495,276). However, the use of auxiliary fine particles of high refractive index in an effort to reduce the amount of electrically-conductive metal-containing particle employed is not beneficial since it will result in the formation of a hazy, high minimum density coating. Moreover, the layer will be brittle and subject to cracking. It has been proposed heretofore to utilize the combination of a binder, such as a hydrophilic colloid, an electrically-conductive metal oxide particle, such as dopes tin oxide, and an electroconductive polymer such as poly(sodium styrene sulfonate) or other polyelectrolyte (see for example, U.S. Pat. Nos. 4,275,103 and 5,122,445). However, water-soluble polymers, such as polyelectrolytes, do not significantly reduce the volume fraction of electrically-conductive metal-containing particles needed for good conductivity. This is especially the case at low humidity where polyelectrolytes contribute little to conductivity. Combining a water-soluble polymer such as polyacrylamide, hydroxyethyl cellulose, polyvinyl pyrrolidine or polyvinyl alcohol with gelatin yields results that are no different than using gelatin alone. Thus, it is a key feature of the present invention to utilize water-insoluble polymer particles in an amount effective to permit the use of low volumetric concentrations of the electrically-conductive metal-containing particles.

Similar results to those described in the above examples can be obtained by using hydrophilic colloids other than gelatin, by using water-insoluble polymer particles other than those described, and by using electrically-conductive metal-containing particles other than antimony-doped tin oxide.

The invention has been described in detail, with particular reference to certain preferred embodiments thereof, but it should be understood that variations and modifications can be effected within the spirit and scope of the invention.

We claim:

1. An imaging element for use in an image-forming process; said imaging element comprising a support, an image-forming layer, and an electrically-conductive layer; said electrically-conductive layer comprising a film-forming hydrophilic colloid having dispersed therein both electrically-conductive metal-containing particles and water-insoluble polymer particles; said electrically-conductive metal-containing particles having an average particle size of less than 0.3 micrometers and constituting about 10 to about 50 volume percent of said electrically-conductive layer, and said water-insoluble polymer particles having an average particle size of from about 10 to about 500 nanometers and being present in said electrically-conductive layer in an amount of from about 0.3 to about 3 parts per part by weight of said film-forming hydrophilic colloid.

2. An imaging element as claimed in claim 1, wherein said electrically-conductive metal-containing particles have an average particle size of less than 0.1 micrometers.

3. An imaging element as claimed in claim 1, wherein said electrically-conductive metal-containing particles constitute 15 to 35 volume percent of said electrically-conductive layer.

4. An imaging element as claimed in claim 1, wherein said electrically-conductive metal-containing particles exhibit a powder resistivity of $10^5$ ohm-centimeters or less.

5. An imaging element as claimed in claim 1, wherein said electrically-conductive metal-containing particles are doped metal oxides.

6. An imaging element as claimed in claim 1, wherein said electrically-conductive metal-containing particles are metal oxides containing oxygen deficiencies.

7. An imaging element as claimed in claim 1, wherein said electrically-conductive metal-containing particles are metal nitrides, carbides or borides.

8. An imaging element as claimed in claim 1, wherein said electrically-conductive metal-containing particles are particles of antimony-doped tin oxide.

9. An imaging element as claimed in claim 1, wherein said electrically-conductive metal-containing particles are particles of aluminum-doped zinc oxide.

10. An imaging element as claimed in claim 1, wherein said electrically-conductive metal-containing particles are particles of niobium-doped titanium oxide.

11. An imaging element as claimed in claim 1, wherein said film-forming hydrophilic colloid is gelatin.

12. An imaging element as claimed in claim 1, wherein said water-insoluble polymer particles have an average particle size of from 20 to 300 nanometers.

13. An imaging element as claimed in claim 1, wherein said water-insoluble polymer particles are selected from the group consisting of polymers of styrene, derivatives of styrene, alkyl acrylates, derivatives of alkyl acrylates, alkyl methacrylates, derivatives of alkyl methacrylates, olefins, vinylidene chloride, acrylonitrile, acrylamide, derivatives of acrylamide, methacrylamide, derivatives of methacrylamide, vinyl esters, vinyl ethers and urethanes.

14. An imaging element as claimed in claim 1, wherein said water-insoluble polymer particles are particles of a terpolymer of styrene, n-butyl methacrylate and the sodium salt of 2-sulfoethyl methacrylate.

15. An imaging element as claimed in claim 1, wherein said water-insoluble polymer particles are particles of a terpolymer of methyl acrylate, vinylidene chloride and iraconic acid.

16. An imaging element as claimed in claim 1, wherein said water-insoluble polymer particles are particles of polymethyl methacrylate.

17. An imaging element as claimed in claim 1, wherein said water-insoluble polymer particles have a refractive index in the range of from about 1.3 to about 1.7.

18. An imaging element as claimed in claim 1, wherein said water-insoluble polymer particles have a refractive index of from 1.4 to 1.6.

19. An imaging element as claimed in claim 1, wherein said water-insoluble polymer particles are present in said electrically-conductive layer in an amount of from 0.5 to 2 parts per part by weight of said film-forming hydrophilic colloid.

20. An imaging element as claimed in claim 1, wherein said electrically-conductive layer has a dry weight coverage of from about 100 to about 1500 $mg/m^2$.

21. An imaging element as claimed in claim 1, wherein said support is a transparent polymeric film, said image-forming layer is comprised of silver halide grains dispersed in gelatin, said film-forming hydrophilic colloid in said electrically-conductive layer is gelatin, said electrically-conductive metal-containing particles are antimony-doped tin oxide particles, and said electrically-conductive layer has a surface resistivity of less than $1\times10^{10}$ ohms/square and a UV-density of less than 0.015.

22. An imaging element as claimed in claim 1, wherein said support is a cellulose acetate film.

23. An imaging element as claimed in claim 1, wherein said support is a poly(ethylene terephthalate) film or a poly(ethylene naphthalate) film.

24. An imaging element as claimed in claim 1, wherein said element is a photographic film.

25. An imaging element as claimed in claim 1, wherein said element is a photographic paper.

26. An imaging element as claimed in claim 1, wherein said element is an electrostatographic element.

27. An imaging element as claimed in claim 1, wherein said element is a photothermographic element.

28. An imaging element as claimed in claim 1, wherein said element is an element adapted for use in a laser toner fusion process.

29. An imaging element as claimed in claim 1, wherein said element is a thermal-dye-transfer receiver element.

30. A photographic film comprising:

(1) a support;

(2) an electrically-conductive layer which serves as an antistatic layer overlying said support; and (3) a silver halide emulsion layer overlying said electrically-conductive layer; said electrically-conductive layer comprising a film-forming hydrophilic colloid having dispersed therein both electrically-conductive metal-containing particles and water-insoluble polymer particles; said electrically-conductive metal-containing particles having an average particle size of less than 0.3 micrometers and constituting about 10 to about 50 volume percent of said electrically-conductive layer, and said water-insoluble polymer particles having an average particle size of from about 10 to about 500 nanometers and being present in said electrically-conductive layer in an amount of from about 0.3 to about 3 parts per part by weight of said film-forming hydrophilic colloid.

31. A photographic film comprising:

(1) a support;

(2) a silver halide emulsion layer on one side of said support;

(3) an electrically-conductive layer which serves as an antistatic layer on the opposite side of said support; and (4) an anti-curl layer overlying said electrically-conductive layer; said electrically-conductive layer comprising a film-forming hydrophilic colloid having dispersed therein both electrically-conductive metal-containing particles and water-insoluble polymer particles; said electrically-conductive metal-containing particles having an average particle size of less than 0.3 micrometers and constituting about 10 to about 50 volume percent of said electrically-conductive layer, and said water-insoluble polymer particles having an average particle size of from about 10 to about 500 nanometers and being present in said electrically-conductive layer in an amount of from about 0.3 to about 3 parts per part by weight of said film-forming hydrophilic colloid.

32. A photographic film comprising a cellulose ester or polyester support, an image-forming layer comprising a silver halide emulsion, and an electrically-conductive layer which serves as an antistatic layer; said electrically-conductive layer comprising gelatin having dispersed therein both electrically-conductive metal oxide particles and water-insoluble polymer particles, said electrically-conductive metal oxide particles having an average particle size of less than 0.1 micrometers and constituting 15 to 35 volume percent of said electrically-conductive layer, and said water-insoluble polymer particles having an average particle size of from 20 to 300 nanometers and being present in said electrically-conductive layer in an amount of from 0.5 to 2 parts per part by weight of gelatin.

* * * * *